US010436216B2

(12) United States Patent
Uesugi et al.

(10) Patent No.: US 10,436,216 B2
(45) Date of Patent: Oct. 8, 2019

(54) TURBOCHARGER

(71) Applicants: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

(72) Inventors: Tsuyoshi Uesugi, Kariya (JP); Koichi Yonezawa, Toyota (JP)

(73) Assignees: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 838 days.

(21) Appl. No.: 15/071,418

(22) Filed: Mar. 16, 2016

(65) Prior Publication Data

US 2016/0273548 A1 Sep. 22, 2016

(30) Foreign Application Priority Data

Mar. 18, 2015 (JP) ..... 2015-055108

(51) Int. Cl.

| | |
|---|---|
| ***F04D 29/44*** | (2006.01) |
| ***F04D 29/42*** | (2006.01) |
| ***F04D 29/58*** | (2006.01) |
| ***F04D 29/62*** | (2006.01) |
| *F02B 37/00* | (2006.01) |

(52) U.S. Cl.

CPC ..... *F04D 29/4206* (2013.01); *F04D 29/584* (2013.01); *F04D 29/5853* (2013.01); *F04D 29/624* (2013.01); *F02B 37/00* (2013.01); *F05D 2220/40* (2013.01); *F05D 2230/21* (2013.01)

(58) Field of Classification Search

None

See application file for complete search history.

(56) References Cited

U.S. PATENT DOCUMENTS 6,257,834 B1 * 7/2001 Bremer ..... F01D 25/12 415/176
7,367,190 B2 * 5/2008 Shibui ..... F01D 25/125 290/52

(Continued)

FOREIGN PATENT DOCUMENTS

EP 2 108 846 A2 10/2009
JP 2000130176 A 5/2000

(Continued)

OTHER PUBLICATIONS

Communication dated Mar. 1, 2017, from the Japanese Patent Office in counterpart application No. 2015-055108.

(Continued)

*Primary Examiner* — Kayla Mccaffrey
(74) *Attorney, Agent, or Firm* — Sughrue Mion, PLLC

(57) ABSTRACT

A turbocharger includes a cooling passage. The cooling passage is arranged along a diffuser surface, which faces a diffuser passage in a compressor housing member. The compressor housing member is constituted by combining a first piece, a second piece, and a third piece, which are produced by die casting or the like. The cooling passage is defined by assembling the first piece and the second piece to each other.

6 Claims, 3 Drawing Sheets

(56) References Cited

U.S. PATENT DOCUMENTS

| | | | | |
|---|---|---|---|---|
| 7,530,230 | B2 * | 5/2009 | Shibui | F02B 37/04 290/52 |
| 7,673,452 | B2 * | 3/2010 | Shimizu | F01D 25/12 290/52 |
| 2015/0020783 | A1 | 1/2015 | Sadamitsu et al. | |
| 2016/0156236 | A1 * | 6/2016 | Metz | F02B 33/40 417/423.7 |

FOREIGN PATENT DOCUMENTS

| | | | | |
|---|---|---|---|---|
| JP | 5359403 | B2 | 12/2013 | |
| JP | 201488785 | A | 5/2014 | |
| JP | 2014152730 | A | 8/2014 | |
| WO | 2013132577 | A1 | 9/2013 | |
| WO | WO-2013132577 | A1 * | 9/2013 | F02B 39/00 |

OTHER PUBLICATIONS

Communication dated Feb. 9, 2018 from the State Intellectual Property Office of the P.R.C. in counterpart application No. 201610143534.9.

* cited by examiner

TURBOCHARGER

BACKGROUND OF THE INVENTION

The present invention relates to a turbocharger.

Conventionally, turbochargers have been used, which utilizes kinetic energy of exhaust gas discharged by internal combustion engines to supercharge air to the engines. A typical turbocharger includes a turbine located in the exhaust system of an internal combustion engine and a compressor located in the intake system of the engine. When drawn into the turbine, exhaust gas discharged by the engine rotates the turbine impeller in the turbine. The turbine impeller is coupled to a compressor impeller located in the compressor. Thus, rotation of the turbine impeller rotates the compressor impeller. When the compressor impeller rotates, air drawn in through the compressor inlet is compressed and then delivered to the diffuser passage arranged outward of the compressor impeller. The air is subsequently delivered to a scroll passage. The supply of compressed from the compressor to the internal combustion engine improves the performance of the engine.

An inlet for blow-by gas discharged by the internal combustion engine is provided on the upstream side of the compressor inlet. Blow-by gas refers to gas that has leaked, for example, through clearances between the pistons and the cylinders in an internal combustion engine. Blow-by gas contains lubricating oil and fuel. The air drawn in through the inlet is compressed to become high-pressure compressed air. This increases the temperature of a wall surface that faces the diffuser passage, that is, the diffuser surface, through which the compressed air flows. Droplets containing oil as a main component are solidified at temperatures higher than or equal to, for example, 160° C. Thus, oil and the like are solidified and accumulated on the diffuser surface. Accumulation of oil and the like reduces the area of the diffuser passage, reducing the performance and operating characteristics of the turbocharger.

Japanese Patent No. 5359403 discloses a configuration in which a cooling passage is provided in a compressor housing member. Fluid that flows through the cooling passage cools the diffuser surface, thereby lowering the temperature of the diffuser surface. Accordingly, the temperature of the diffuser surface is kept lower than the temperature at which oil and the like are solidified. This limits solidification of oil and the like on the diffuser surface.

However, since the cooling passage disclosed in Japanese Patent No. 5359403 is provided in the wall of the compressor housing member along the diffuser surface, production of the cooling passage is significantly complicated.

SUMMARY OF THE INVENTION

Accordingly, it is an objective of the present invention to provide a turbocharger that simplifies the production of a cooling passage.

To achieve the foregoing objective and in accordance with one aspect of the present invention, a turbocharger is provided that includes a compressor housing member having a compressor chamber, a compressor impeller accommodated in the compressor chamber, a diffuser passage, which communicates with the compressor chamber and has a shape surrounding the compressor chamber, a diffuser surface, which faces the diffuser passage, and a cooling passage, which extends along the diffuser surface. A fluid for cooling the diffuser surface flows through the cooling passage. The compressor housing member includes a plurality of pieces, which are assembled to each other. The cooling passage is defined by the pieces, which are assembled to each other.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

Figure 1:
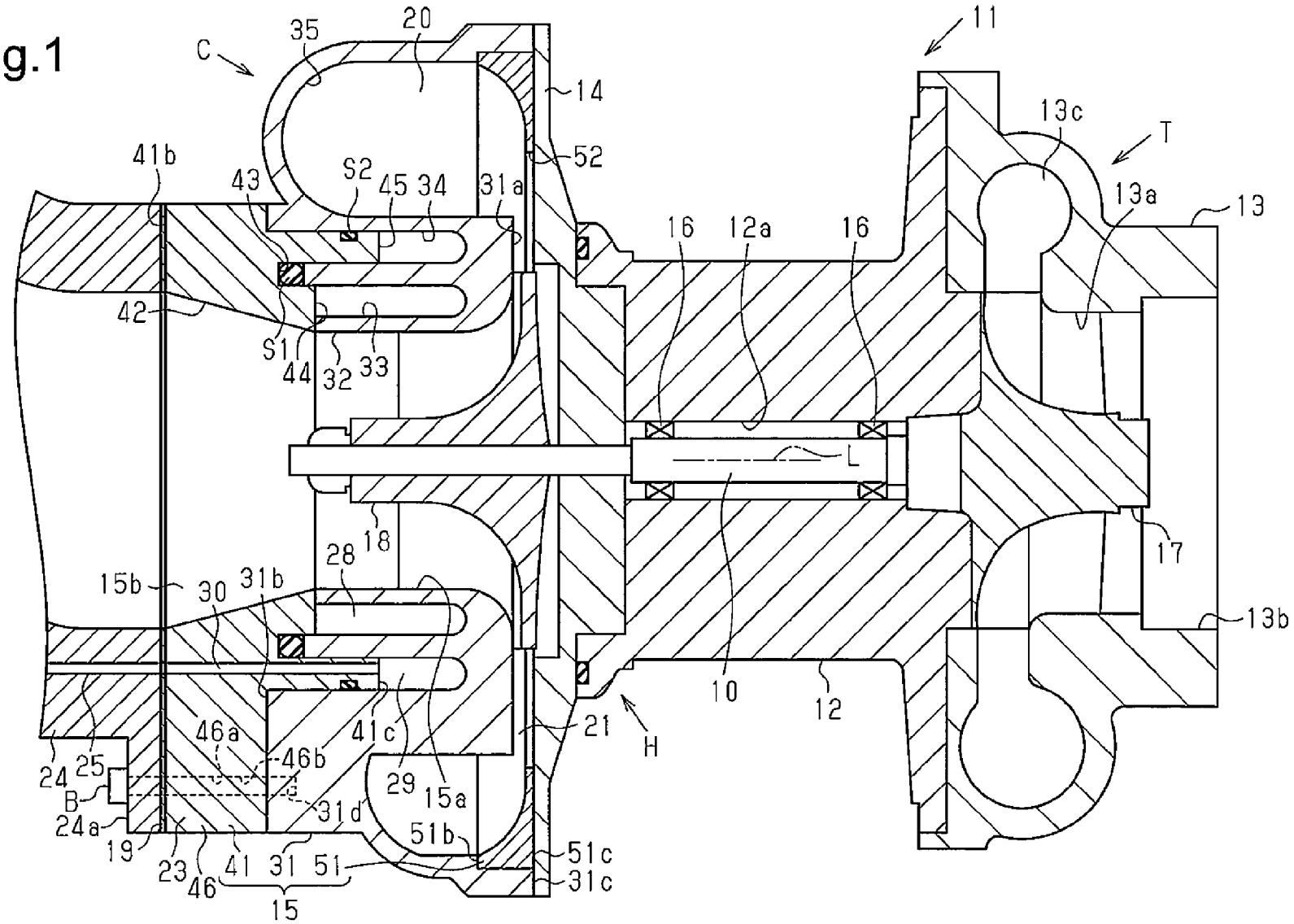
FIG. 1 is a cross-sectional view illustrating a turbocharger according to a first embodiment of the present invention.

A turbocharger 11 according to a first embodiment of the present invention will now be described with reference to FIGS. 1 and 2. The turbocharger 11 of the first embodiment is mounted on a vehicle and employed for an on-vehicle internal combustion engine (hereinafter, referred to as an internal combustion engine). The turbocharger 11 is a forced induction device that utilizes the energy of exhaust of the internal combustion engine to compress intake air and supplies compressed air to the internal combustion engine. In the following description of the turbocharger 11, the left side and the right side as viewed in FIG. 1 are defined as the front side and the rear side, respectively. In addition, the direction in which a central axis L of an impeller shaft 10 (described later) extends is defined as the axial direction, and the direction that intersects the central axis L at right angle is defined as the radial direction.

As shown in FIG. 1, a housing H of the turbocharger 11 includes a bearing housing member 12, a turbine housing member 13 coupled to the rear end of the bearing housing member 12, and a compressor housing member 15 coupled to the front end of the bearing housing member 12 with a seal plate 14 in between. The bearing housing member 12 has a central axis. The turbocharger 11 includes a turbine T arranged in the turbine housing member 13 and a compressor C arranged in the compressor housing member 15. The turbine T is arranged in the exhaust passage (not shown) of the internal combustion engine, and the compressor C is arranged in the intake passage (not shown) of the internal combustion engine.

The bearing housing member 12 has a shaft hole 12*a*, which extends through the bearing housing member 12 in the axial direction. An impeller shaft 10 is rotationally supported in the shaft hole 12*a* via bearings 16. The turbocharger 11 includes a turbine impeller 17, which is coupled to the rear end of the impeller shaft 10, and a compressor impeller 18, which is coupled to the front end of the impeller shaft 10.

The turbine impeller 17 is arranged in the turbine housing member 13, and the compressor impeller 18 is arranged in the compressor housing member 15. The turbine impeller 17 and the compressor impeller 18 are coupled to each other by the impeller shaft 10. Thus, the turbine impeller 17, the impeller shaft 10, and the compressor impeller 18 rotate integrally.

Further, the turbocharger 11 has a turbine chamber 13*a*, which accommodates the turbine impeller 17, an exhaust outlet 13*b*, and a turbine scroll passage 13*c*. The turbine chamber 13*a* and the turbine scroll passage 13*c* are located in the turbine housing member 13. The exhaust outlet 13*b* extends in the axial direction and communicates with the turbine chamber 13*a*. The turbine scroll passage 13*c* has a spiral shape extending along the outer circumference of the turbine impeller 17.

The turbocharger 11 has a compressor chamber 15*a*, which accommodates the compressor impeller 18, and an intake port 15*b*. The compressor chamber 15*a* and the intake port 15*b* are provided inside the compressor housing member 15. The intake port 15*b* extends in the axial direction and communicates with the compressor chamber 15*a*. The axis of the compressor housing member 15 and the axis of the compressor impeller 18 agree with the central axis L of the impeller shaft 10. The intake port 15*b* has a tapered shape with the diameter gradually decreasing from the open end of the compressor housing member 15 toward the compressor impeller 18.

The turbocharger 11 includes a compressor scroll passage 20 and a diffuser passage 21. The compressor scroll passage 20 and the diffuser passage 21 are provided inside the compressor housing member 15. The compressor scroll passage 20 has a spiral shape extending along the outer circumference of the compressor impeller 18 and the compressor chamber 15*a*. The diffuser passage 21 communicates with the compressor chamber 15*a* and has a shape that surrounds the compressor chamber 15*a*. The diffuser passage 21 compresses air that has been taken in through the intake port 15*b*, thereby increasing the pressure of the air. The compressor housing member 15 has an annular diffuser surface 31*a*, which faces the diffuser passage 21.

The turbocharger 11 has, in the compressor housing member 15, an air thermal insulation layer 28, a cooling passage 29, and an introduction passage 30. The air thermal insulation layer 28 has an annular shape that surrounds the compressor chamber 15*a*. The air thermal insulation layer 28 is located radially outward of the compressor chamber 15*a*. Air in the air thermal insulation layer 28 thermally insulates the air that has been drawn into the compressor chamber 15*a* via the intake port 15*b* from the outer circumference.

The cooling passage 29 also has an annular shape that surrounds the air thermal insulation layer 28. The cooling passage 29 is located radially outward of the air thermal insulation layer 28. The air thermal insulation layer 28 is located radially inward of the cooling passage 29. The cooling passage 29 extends along the diffuser surface 31*a* and is arranged to surround the compressor chamber 15*a*. Coolant for cooling the internal combustion engine flows through the cooling passage 29. The coolant that flows through the cooling passage 29 cools the diffuser surface 31*a*.

The introduction passage 30 is provided to conduct coolant from a water jacket 25, which will be discussed below, to the compressor housing member 15. The introduction passage 30 extends linearly along the axis of the compressor housing member 15. The front end of the introduction passage 30 has an opening in the open end of the compressor housing member 15, which surrounds the intake port 15*b*. The rear end of the introduction passage 30 communicates with the cooling passage 29. The compressor housing member 15 includes a first sealing member S1 and a second sealing member S2, which seals the cooling passage 29 in a liquid-tight manner.

The intake port 15*b* communicates with the diffuser passage 21 via the compressor chamber 15*a*. The diffuser passage 21 communicates with the compressor scroll passage 20. The compressor scroll passage 20 communicates with an outlet (not shown).

The compressor housing member 15 has a connection flange 23 in the vicinity of the open end. The connection flange 23 has an internal thread hole 46*a*. The open end of the compressor housing member 15 is connected to an intake pipe 24 via a plate-shaped sealing member 19.

The intake pipe 24 also has a flange 24*a* at the open end. The flange 24*a* has a hole for receiving a bolt B. The bolt B is passed through the flange 24*a* and threaded into the internal thread hole 46*a* of the compressor housing member 15, thereby connecting the intake pipe 24 to the compressor housing member 15. The intake pipe 24 has a water jacket 25 in the outer peripheral portion. Some of the coolant for cooling the internal combustion engine flows through the water jacket 25. The intake pipe 24 also has an inlet (not shown) for blow-by gas discharged from the internal combustion engine. The blow-by gas is mixed with the air flowing through the intake port 15*b*.

The structure of the compressor housing member 15 will now be described with reference to FIGS. 1 and 2.

Figure 2:
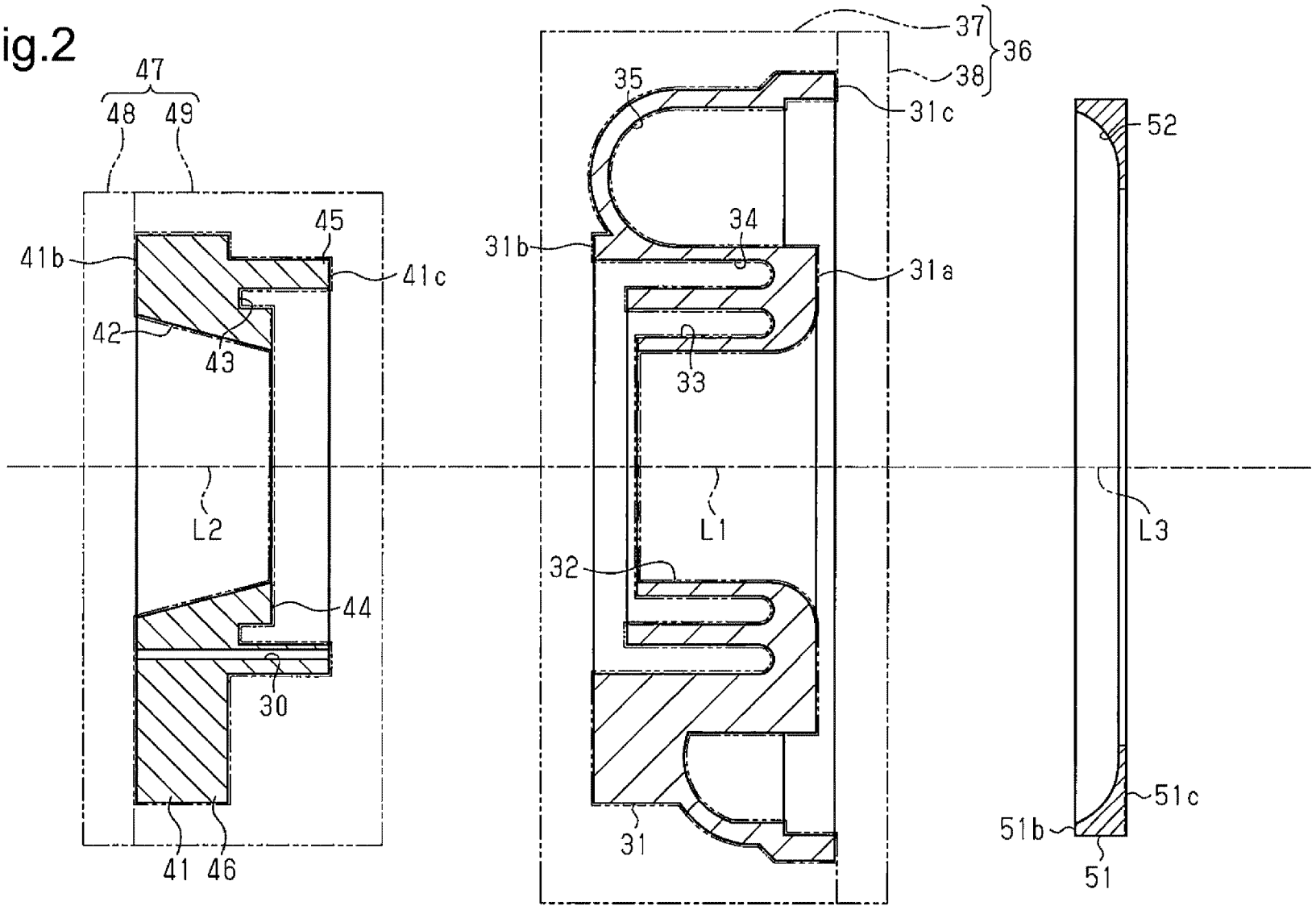
FIG. 2 is an exploded cross-sectional view of the compressor housing member.

As shown in FIGS. 1 and 2, the compressor housing member 15 is constituted by three pieces. The compressor housing member 15 is fixed to the seal plate 14. The compressor housing member 15 is formed by assembling a first piece 31, a second piece 41, and a third piece 51. The first piece 31, the second piece 41, and the third piece 51 are produced by die casting an aluminum alloy.

The first piece 31 has a cylindrical shape. The first piece 31 has a central axis L1. The first piece 31 has a first through hole 32, which is a circular hole having the same axis as the central axis L1. The inner wall surface of the first through hole 32 defines the compressor chamber 15*a*.

The front end face of the first piece 31, which faces the second piece 41, is defined as a first end face 31*b*, and the rear end face, which faces the third piece 51, is defined as a second end face 31*c*. In the vicinity of the second end face 31*c*, the first through hole 32 is curved so that the inner diameter gradually decreases along the axis of the first piece 31 from the second end face 31*c* toward the first end face 31*b*. The first piece 31 has the above described diffuser surface 31*a* at a part parallel with the second end face 31*c*.

The first piece 31 has a first recess 33 at a position radially outward of the first through hole 32. The first recess 33 has an annular shape surrounding the first through hole 32. The first recess 33 extends in the axial direction from the first end face 31*b* toward the second end face 31*c*. The inner wall surface of the first recess 33 is a cylindrical surface extending along the axial direction. The width of the first recess 33 is slightly reduced at the bottom. Further, the first piece 31 has a second recess 34 at a position radially outward of the first recess 33. The second recess 34 also has an annular shape surrounding the first recess 33. The second recess 34 extends in the axial direction from the first end face 31*b* toward the second end face 31*c*. The inner wall surface of the second recess 34 is a cylindrical surface extending along the axial direction. The width of the second recess 34 is slightly reduced at the bottom. The second recess 34 defines the cooling passage 29. The second recess 34 has an annular opening, which is located in the first end face 31*b* of the first piece 31 and extends along the cooling passage 29.

The first piece 31 has a passage-defining recess 35 at a position radially outward of the second recess 34. The passage-defining recess 35 surrounds the second recess 34. The passage-defining recess 35 extends in the axial direction from the second end face 31*c* toward the first end face 31*b*. The inner wall surface of the passage-defining recess 35 is a cylindrical surface extending along the axis. The width of the passage-defining recess 35 is reduced toward the bottom. The first piece 31 has a first internal thread portion 31*d*, which is a recess that extends from the first end face 31*b* toward the second end face 31*c*.

As represented by the long dashed double-short dashed lines in FIG. 2, the first piece 31 is produced using a mold 36. The mold 36 includes a first mold half 37 and a second mold half 38. The first mold half 37 is used to mold the outer shape of the first end face 31*b* of the first piece 31, the first recess 33, and the second recess 34. The second mold half 38 is used to mold the outer shape of the second end face 31*c* of the first piece 31, the passage-defining recess 35, and the first through hole 32. The inner wall surfaces of the first recess 33, the second recess 34, and the passage-defining recess 35 are cylindrical surfaces that extend in the same direction as the mold opening direction, that is, the demolding direction. This allows the first mold half 37 and the second mold half 38 to be easily opened. The first internal thread portion 31*d* is formed after the first piece 31 is molded.

The second piece 41 has a cylindrical shape. The second piece 41 has a central axis L2. The second piece 41 has a second through hole 42, which has the same axis as the central axis L2. The inner wall surface of the second through hole 42 defines the intake port 15*b*. The front end face of the second piece 41, which faces the open end of the intake pipe 24, is defined as a first end face 41*b*, and the rear end face, which faces the first piece 31, is defined as a second end face 41*c*. The inner diameter of the second through hole 42 decreases from the first end face 41*b* toward the second end face 41*c*. The outer diameter of the second piece 41 at the second end face 41*c* is substantially equal to the inner diameter of the first piece 31 at the first end face 31*b*.

The second piece 41 has a first cylindrical portion 44, which protrudes toward the first piece 31. The first cylindrical portion 44 surrounds the second through hole 42. The inner diameter of the first cylindrical portion 44 is equal to or substantially equal to the diameter of the first through hole 32 of the first piece 31. The outer diameter of the first cylindrical portion 44 is equal to or substantially equal to the outer diameter of the first recess 33 of the first piece 31. The second piece 41 has an annular attachment recess 43 at a position radially outward of the first cylindrical portion 44. The attachment recess 43 extends in the axial direction from the second end face 41*c* toward the first end face 41*b*. The above described first sealing member S1 is attached to the attachment recess 43. The inner surface of the attachment recess 43 is a cylindrical surface extending in the axial direction.

Further, the second piece 41 has a second cylindrical portion 45 at a position radially outward of the attachment recess 43. The second cylindrical portion 45 is a closing portion that closes the opening of the second recess 34 of the first piece 31. The second cylindrical portion 45 has a cylindrical shape surrounding the attachment recess 43. The inner diameter of the second cylindrical portion 45 is slightly larger than the inner diameter of the second recess 34 of the first piece 31, and the outer diameter of the second cylindrical portion 45 is slightly smaller than the outer diameter of the second recess 34. This allows the second cylindrical portion 45 to be inserted in the second recess 34.

The second piece 41 has a flange forming portion 46 on the outer circumferential surface in the vicinity of the first end face 41*b*. The flange forming portion 46 forms the connection flange 23 of the compressor housing member 15. The second piece 41 has a second internal thread portion 46*b*, which extends in the axial direction through the connection flange 23. The second internal thread portion 46*b* constitutes the internal thread hole 46*a* together with the first internal thread portion 31*d* of the first piece 31. The second piece 41 has the above described introduction passage 30. The introduction passage 30 extends in the axial direction through a part of the second piece 41 that includes the second cylindrical portion 45.

The second piece 41 is produced using a mold 47. The mold 47 includes a first mold half 48 and a second mold half 49. The first mold half 48 is used to mold the outer shape of the first end face 41*b* of the second piece 41 and the second through hole 42. The second mold half 49 is used to mold the outer shape of the second end face 41*c* of the second piece 41, the attachment recess 43, the first cylindrical portion 44, the second cylindrical portion 45, and the introduction passage 30. The second through hole 42 has a diameter that increases in the mold opening direction of the first mold half 48. The inner wall surfaces of the first cylindrical portion 44, the second cylindrical portion 45, and the introduction passage 30 are cylindrical surfaces that extends in the mold opening direction (demolding direction) of the second mold half 49. This allows the first mold half 48 and the second mold half 49 to be easily opened. The recess for attaching the second sealing member S2 to the second cylindrical portion 45 and the second internal thread portion 46*b* are formed through cutting after the second piece 41 is produced using the mold 47. The first internal thread portion 31*d* is formed simultaneously with the second internal thread portion 46*b*.

The third piece 51 has a disk-like shape. The third piece 51 has a central axis L3. The front end face of the third piece 51, which faces the compressor scroll passage 20, is defined as a first end face 51*b*, and the rear end face, which faces the seal plate 14, is defined as a second end face 51*c*. The third piece 51 has a third through hole 52, which has the same axis as the central axis L3. The inner diameter of the third through hole 52 decreases from the first end face 51*b* toward the second end face 51*c*. The third piece 51 is located inward of the passage-defining recess 35 of the first piece 31. Although not illustrated, the third piece 51 is also produced using a mold.

As shown in FIG. 1, the compressor housing member 15 is formed by assembling the second piece 41 to the first end face 31*b* of the first piece 31 and assembling the third piece 51 to the second end face 31*c* of the first piece 31. The bolt B is passed through the flange 24*a* of the intake pipe 24 and is threaded to the second internal thread portion 46*b* of the second piece 41 and the first internal thread portion 31*d* of the first piece 31, so that the first piece 31 and the second piece 41 are integrated. The third piece 51 is press fitted to the inner circumferential surface of the passage-defining recess 35 of the first piece 31 to be integrated with the first piece 31.

The compressor scroll passage 20 is defined by the inner wall surface of the passage-defining recess 35 of the first piece 31 and the inner wall surface of the third piece 51. The diffuser passage 21 is defined between the diffuser surface 31*a* of the first piece 31 and the front end face of the seal plate 14.

The air thermal insulation layer 28 is defined by closing the first recess 33 of the first piece 31 with the first cylindrical portion 44 of the second piece 41. The cooling passage 29 is defined by inserting the second cylindrical portion 45 of the second piece 41 into the second recess 34 of the first piece 31 to close the opening of the second recess 34. The cooling passage 29 is sealed by the first sealing member S1 and the second sealing member S2 in a liquid-tight manner. When the second cylindrical portion 45 is inserted into the second recess 34 of the first piece 31, the introduction passage 30, which extends through the second cylindrical portion 45, communicates with the cooling passage 29. The intake port 15*b* of the compressor housing member 15 is defined by the second through hole 42 of the second piece 41. The compressor chamber 15*a* is defined by the first through hole 32 of the first piece 31.

The intake pipe 24 is connected to the connection flange 23 of the compressor housing member 15 via the sealing member 19. The cooling passage 29 is formed by assembling the first piece 31 and the second piece 41 to each other in the axial direction of the compressor impeller 18. The water jacket 25 of the intake pipe 24 communicates with the introduction passage 30 of the second piece 41. The introduction passage 30 thus connects the water jacket 25 and the cooling passage 29 to each other. Coolant that has been drawn into the cooling passage 29 is conducted out of the compressor housing member 15 via an outlet passage (not shown)

Operation of the turbocharger 11 will now be described with reference to FIG. 1.

As shown in FIG. 1, exhaust gas discharged from the internal combustion engine is delivered to the turbine scroll passage 13*c* via the exhaust gas inlet (not shown) of the turbine housing member 13. The exhaust gas is drawn into the turbine chamber 13*a* while swirling about the turbine impeller 17 in the turbine scroll passage 13*c*. The introduction of the exhaust gas into the turbine chamber 13*a* rotates the impeller shaft 10. After rotating the impeller shaft 10, the exhaust gas is discharged through the exhaust outlet 13*b* of the turbine housing member 13. The exhaust gas is the purified by the exhaust gas purification device and released to the atmosphere.

The turbine impeller 17 is coupled to the compressor impeller 18 via the impeller shaft 10. Thus, rotation of the turbine impeller 17 rotates the compressor impeller 18. When the compressor impeller 18 rotates, air is delivered to the diffuser passage 21 via the intake pipe 24 and the intake port 15*b*. At this time, blow-by gas is also drawn into the diffuser passage 21 via the intake port 15*b*. The drawn air is compressed by flowing through the diffuser passage 21. The compressed air flows through the compressor scroll passage 20 and is supplied to the internal combustion engine via the outlet (not shown).

Some of the coolant flowing through the water jacket 25 is drawn into the cooling passage 29 via the introduction passage 30. The coolant cools the diffuser surface 31*a* of the first piece 31.

The first embodiment has the following advantages.

(1) The turbocharger 11 has the cooling passage 29, which is used to cool the diffuser surface 31*a* of the compressor housing member 15. When assembling the compressor housing member 15, the cooling passage 29 is formed by inserting the second cylindrical portion 45 of the second piece 41 into the second recess 34 of the first piece 31. The first piece 31 is produced with the mold 36 without using a core. The second piece 41 is also produced with the mold 47 without using a core. In this manner, the first piece 31 and the second piece 41 are produced using the molds 36, 47 having simple structures. Also, the cooling passage 29 is formed in the compressor housing member 15 simply by assembling the first piece 31 and the second piece 41 together.

(2) The cooling passage 29 is formed by assembling the first piece 31 and the second piece 41 to each other in the axial direction of the compressor impeller 18. The cooling passage 29 is provided in the compressor housing member 15. This structure allows the cooling passage 29 to be located in the vicinity of the diffuser surface 31*a*. Thus, the coolant flowing through the cooling passage 29 effectively lowers the temperature of the diffuser surface 31*a*. Therefore, the temperature of the diffuser surface 31*a* is kept lower than the temperature at which oil and the like solidify, so that solidification of oil and the like is limited.

(3) The first sealing member S1 is attached to the attachment recess 43 of the second piece 41. The second sealing member S2 is attached to the outer circumferential surface of the second cylindrical portion 45. With this structure, the first piece 31 and the second piece 41 are assembled to each other so that the cooling passage 29 is sealed in a liquid-tight manner by the first sealing member S1 and the second sealing member S2.

(4) When the first piece 31 and the second piece 41 are assembled to each other in the axial direction of the compressor impeller 18, the second recess 34 of the first piece 31 is closed by the second cylindrical portion 45 of the second piece 41. This allows the cooling passage 29 to be easily formed in the compressor housing member 15.

(5) The turbocharger 11 has the air thermal insulation layer 28 in the compressor housing member 15. The air thermal insulation layer 28 is defined by closing the first recess 33 of the first piece 31 with the first cylindrical portion 44 of the second piece 41. The first piece 31 is produced with the mold 36 without using a core. The second piece 41 is also produced with the mold 47 without using a core. Thus, the first piece 31 and the second piece 41 are produced using the molds 36, 47 having simple structures. Also, the air thermal insulation layer 28 is formed in the compressor housing member 15 simply by assembling the first piece 31 and the second piece 41 together.

(6) The turbocharger 11 has the air thermal insulation layer 28 in the compressor housing member 15. The air thermal insulation layer 28 is located between the cooling passage 29 and the compressor chamber 15*a* in a view of the radial direction. Thus, the air thermal insulation layer 28 limits heat transfer from the coolant flowing through the cooling passage 29 to the air drawn into the compressor chamber 15*a*. Since this limits temperature increase of the air before being compressed, the temperature increase of the air after being compressed is also limited.

(7) The air thermal insulation layer 28 is defined by closing the first recess 33 of the first piece 31 with the first cylindrical portion 44 of the second piece 41. In this structure, the first recess 33 is provided in the first piece 31 to form the air thermal insulation layer 28, which reduces the weight of the first piece 31.

(8) The cooling passage 29 is formed by inserting the second cylindrical portion 45 into the second recess 34 of the first piece 31. Thus, the length of the second cylindrical portion 45 inserted in the second recess 34 can be changed by preparing several types of second pieces 41 with different lengths of the second cylindrical portions 45 and selecting one of the second pieces 41. This allows the cross-sectional area of the cooling passage 29 to be changed. Therefore, by selecting one of the second pieces 41, a cooling passage 29 that is in conformity to the type and performance of the turbocharger 11 is formed in the compressor housing member 15.

Second Embodiment

A turbocharger according to a second embodiment will now be described with reference to FIGS. 3 and 4. Detailed explanations of those components that are like or the same as the corresponding components of the first embodiment are omitted.

Figure 4:
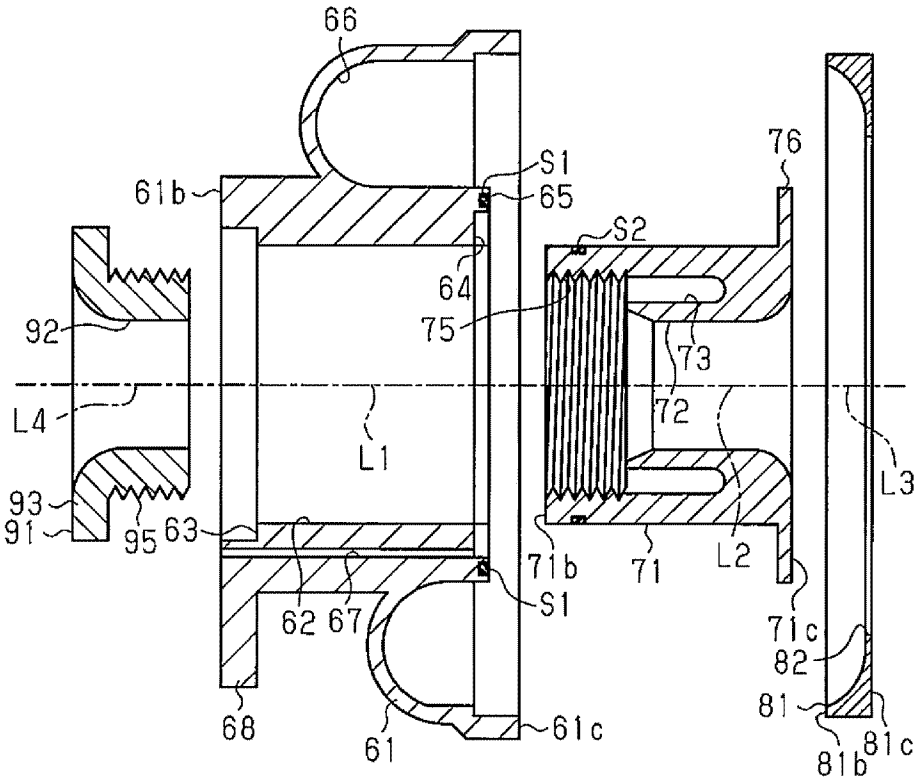
FIG. 4 is an exploded cross-sectional view of the compressor housing member.
Figure 3:
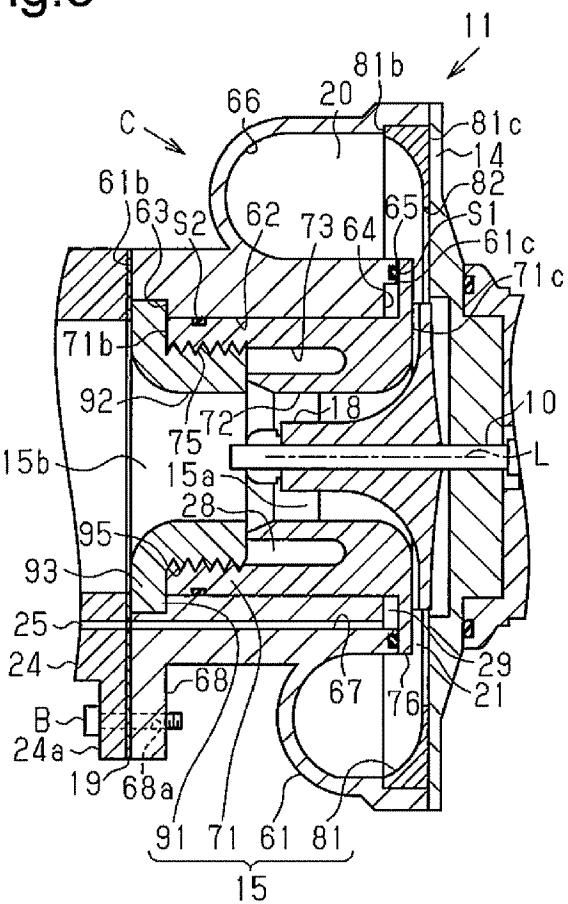
FIG. 3 is a cross-sectional view illustrating a turbocharger according to a second embodiment.

As shown in FIGS. 3 and 4, a compressor housing member 15 is formed by assembling four pieces, or a first piece 61, a second piece 71, a third piece 81, and a fourth piece 91. The first piece 61, the second piece 71, the third piece 81, and the fourth piece 91 are produced by die casting an aluminum alloy.

The first piece 61 has a cylindrical shape. The first piece 61 has a central axis L1. The first piece 61 has a first through hole 62, which has the same axis as the central axis L1. The front end face of the first piece 61, which faces the intake pipe 24, is defined as a first end face 61*b*, and the rear end face is defined as a second end face 61*c*.

The first piece 61 has a supporting recess 63 at a position radially outward of the first through hole 62. The supporting recess 63 has annular shape surrounding the first through hole 62. The supporting recess 63 extends in the axial direction from the first end face 61*b* toward the second end face 61*c*. An annular recess 64 is formed in the second end face 61*c* of the first piece 61 to surround the first through hole 62. The recess 64 extends in the axial direction from the second end face 61*c* toward the first end face 61*b*. An attachment recess 65 is formed in the second end face 61*c* of the first piece 61 to surround the recess 64. The attachment recess 65 extends in the axial direction from the second end face 61*c* toward the first end face 61*b*. The first sealing member S1 is attached to the attachment recess 65.

The first piece 61 has a passage-defining recess 66 at a position radially outward of the attachment recess 65. The passage-defining recess 66 extends in the axial direction from the second end face 61*c* toward the first end face 61*b*. The inner wall surface of the passage-defining recess 66 is a cylindrical surface that extends in the axial direction from the second end face 61*c* toward the first end face 61*b*. The first piece 61 has an introduction passage 67, which connects the first end face 61*b* and the recess 64 to each other. The introduction passage 67 extends in the axial direction through the first piece 61. As in the first embodiment, the first piece 61 is produced using a mold (not shown). The first piece 61 also has a flange forming portion 68 on the outer circumferential surface of the first end face 61*b*.

The second piece 71 has a cylindrical shape. The second piece 71 has a central axis L2. The front end face of the second piece 71 is defined as a first end face 71*b*, and the rear end face is defined as a second end face 71*c*. The second piece 71 has a second through hole 72, which has the same axis as the central axis L2. The inner wall surface of the second through hole 72 defines the compressor chamber 15*a*. In the vicinity of the second end face 71*c*, the second through hole 72 is curved so that the inner diameter gradually decreases from the second end face 71*c* toward the first end face 71*b*. The second piece 71 has a diffuser surface that is defined by the second end face 71*c*. The second piece 71 has an internal thread portion 75 in the inner circumferential surface close to the front end.

Further, the second piece 71 has an annular recess 73, which surrounds the second through hole 72. The annular recess 73 is arranged between the internal thread portion 75 and the second end face 71*c*. The annular recess 73 extends in the axial direction from the first end face 71*b* of the second piece 71 toward the second end face 71*c*. Further, the second piece 71 has a passage-defining flange 76 at the second end face 71*c*. The passage-defining flange 76 has a disk-like shape. In addition, a second sealing member S2 is attached to the front end of the outer circumferential surface of the second piece 71. As in the first embodiment, the second piece 71 is produced using a mold (not shown). The groove for receiving the second sealing member S2 and the internal thread portion 75 are formed after the second piece 71 is produced using a mold.

The third piece 81 has the same structure as the third piece 51 of the first embodiment and has a disk-like shape. The third piece 81 has a central axis L3. The front end face of the third piece 81, which faces the compressor scroll passage 20, is defined as a first end face 81*b*, and the rear end face, which faces the seal plate 14, is defined as a second end face 81*c*. The third piece 81 has a third through hole 82, which has the same axis as the central axis L3. The inner diameter of the third through hole 82 decreases from the first end face 81*b* toward the second end face 81*c*. The third piece 81 is located inward of the passage-defining recess 66 of the first piece 61. As in the first embodiment, the third piece 81 is produced using a mold (not shown).

The fourth piece 91 has a cylindrical shape. The fourth piece 91 has a central axis L4. The fourth piece 91 has a fourth through hole 92, which has the same axis as the central axis L4. The inner wall surface of the fourth through hole 92 defines an intake port 15*b*. The fourth piece 91 has a flange 93 in the vicinity of the front end of the outer circumferential surface. The flange 93 is fitted in and supported by the supporting recess 63 of the first piece 61. The fourth piece 91 has an external thread portion 95 on the outer circumferential surface except the flange 93. The external thread portion 95 can be threaded to the internal thread portion 75 of the second piece 71. As in the first embodiment, the fourth piece 91 is produced using a mold (not shown). The external thread portion 95 is formed after producing the fourth piece 91 using a mold.

As shown in FIG. 3, the second piece 71 is pressed in the first through hole 62 of the first piece 61, and the external thread portion 95 of the fourth piece 91 is threaded to the internal thread portion 75 of the second piece 71. Further, the flange 93 of the fourth piece 91 is supported by the supporting recess 63 of the first piece 61, and the flange 93 and the passage-defining flange 76 of the second piece 71 hold the first piece 61 in the axial direction. The third piece 81 is pressed in and supported by the passage-defining recess 66 of the first piece 61. Thus, the first piece 61, the second piece 71, and the fourth piece 91 are integrated to constitute the compressor housing member 15.

The compressor scroll passage 20 is defined by the inner wall surface of the passage-defining recess 66 of the first piece 61 and the inner wall surface of the third piece 81. The diffuser passage 21 is defined between the second end face 71*c*, which defines the diffuser surface of the second piece 71 and the end face of the seal plate 14.

An air thermal insulation layer 28 is defined by closing the annular recess 73 of the second piece 71 with the fourth piece 91. The cooling passage 29 is defined by closing the recess 64 of the first piece 61 with the outer circumferential surface of the second piece 71 and the passage-defining flange 76. The cooling passage 29 is sealed by the first sealing member S1 and the second sealing member S2 in a liquid-tight manner. The introduction passage 67 of the first piece 61 communicates with the cooling passage 29.

The intake port 15*b* is defined by the fourth through hole 92 of the fourth piece 91, and the compressor chamber 15*a* is defined by the second through hole 72 of the second piece 71. The intake pipe 24 is connected to the open end of the compressor housing member 15, which surrounds the intake port 15*b*, via the sealing member 19. Specifically, a bolt B is passed through the flange 24*a* of the intake pipe 24 and is threaded to an internal thread hole 68*a* of the first piece 61, so that the intake pipe 24 is connected to the compressor housing member 15. The water jacket 25 of the intake pipe 24 communicates with the introduction passage 67 of the first piece 61. The introduction passage 67 thus connects the water jacket 25 and the cooling passage 29 to each other.

The flange 24*a*, which is provided at the open end of the intake pipe 24, has a hole for receiving the bolt B. The bolt B is passed through the flange 24*a* and is threaded to the internal thread hole 68*a* in the flange forming portion 68, so that the intake pipe 24 is connected to the compressor housing member 15.

In addition to the advantages of the first embodiment, the second embodiment achieves the following advantage.

(9) The second piece 71 has the internal thread portion 75 and the passage-defining flange 76, and the fourth piece 91 has the external thread portion 95 and the flange 93. The second piece 71 is press fitted in the first piece 61, and the external thread portion 95 of the fourth piece 91 is threaded to the internal thread portion 75 of the second piece 71. Further, the flange 93 of the fourth piece 91 is supported by the supporting recess 63 of the first piece 61. Thus, the first piece 61 is held by the passage-defining flange 76 of the second piece 71 and the flange 93 of the fourth piece 91, so that the first piece 61, the second piece 71, and the fourth piece 91 are integrated.

The above described embodiments may be modified as follows.

In the above illustrated embodiments, the air thermal insulation layer 28 may be omitted. In this case, the first recess 33 of the first piece 31 is omitted from the first embodiment. Also, the annular recess 73 of the second piece 71 is omitted from the second embodiment.

In the above illustrated embodiments, heat insulating material may be accommodated in the first recess 33 or the annular recess 73 to provide a thermal insulation layer.

In the illustrated embodiments, not all the pieces need to be formed by die casting. That is, some of the pieces may be produced by forging, precision casting, or cutting.

In the second embodiment, the space defined by closing the annular recess 73 with the fourth piece 91 may be employed as the cooling passage 29. In this case, the fourth piece 91 may have an introduction passage that connects the space to the water jacket 25.

In the illustrated embodiments, coolant is introduced to the cooling passage 29 from the water jacket 25 of the intake pipe 24, but other configurations may be employed. For example, the coolant of the internal combustion engine may be introduced to the cooling passage 29 via a pipe from a position other than the water jacket 25. In the first embodiment, a pipe for introducing coolant is connected to the second piece 41 to communicate with the introduction passage 30. In the second embodiment, a pipe for introducing coolant is connected to the first piece 61 to communicate with the introduction passage 67.

The shapes of the molds 36, 47 may be changed as necessary. Since the recesses have cylindrical shapes, changes in the shapes of the molds 36, 47 will not influence the mold opening operation.

The fluid that flows through the cooling passage 29 and the water jacket 25 does not necessary need to be coolant, but may be oil or air. The cooling passage 29 may have a complete annular shape or a C-shape that surrounds the diffuser surface substantially entirely.

The invention claimed is:

1. A turbocharger comprising:

a compressor housing member having a compressor chamber;

a compressor impeller accommodated in the compressor chamber;

a diffuser passage, which communicates with the compressor chamber and has a shape surrounding the compressor chamber;

a diffuser surface, which faces the diffuser passage; and a cooling passage, which extends along the diffuser surface, wherein a fluid for cooling the diffuser surface flows through the cooling passage, wherein the compressor housing member includes a plurality of pieces, which are assembled to each other, and the cooling passage is defined by the pieces, which are assembled to each other, the pieces include a first piece and a second piece, the first piece defines the compressor chamber, the first piece has a recess that is recessed from a front end face, of the first piece that faces the second piece, the recess extends in an axial direction of the compressor impeller and the recess has an annular opening in the front end face that faces the second piece, the second piece includes a closing portion that faces the annular opening of the recess and has an annular shape that extends in the axial direction of the compressor impeller, and the first piece and the second piece are assembled to each other in the axial direction of the compressor impeller so that the closing portion of the second piece is disposed inside the recess of the first piece to close the annular opening, so that the cooling passage is defined by the recess and the closing portion.

2. The turbocharger according to claim 1, wherein the compressor housing member includes the compressor chamber, an intake port, which extends in an axial direction of the compressor impeller and communicates with the compressor chamber, and a compressor scroll passage, which surrounds the compressor impeller, communicates with an outer peripheral portion of the diffuser passage, and has a spiral shape, the first piece further defines the diffuser passage, and the compressor scroll passage, and the second piece defines the intake port.

3. The turbocharger according to claim 1, wherein the pieces include a piece that defines the cooling passage and the diffuser surface.

4. The turbocharger according to claim 1, wherein the fluid is coolant of a vehicle-mounted internal combustion engine.

5. A turbocharger comprising:

a compressor housing member having a compressor chamber;

a compressor impeller accommodated in the compressor chamber;

a diffuser passage, which communicates with the compressor chamber and has a shape surrounding the compressor chamber;

a diffuser surface, which faces the diffuser passage;

a cooling passage, which extends along the diffuser surface, wherein a fluid for cooling the diffuser surface flows through the cooling passage, wherein the compressor housing member includes a plurality of pieces, which are assembled to each other, the cooling passage is defined by the pieces, which are assembled to each other; and a thermal insulation layer provided in the compressor housing member, wherein the thermal insulation layer is located between the cooling passage and the compressor chamber in a view of a radial direction that intersects an axial direction of the compressor impeller at right angles, and the thermal insulation layer has a shape that surrounds the compressor chamber.

6. A turbocharger comprising:

a compressor housing member having a compressor chamber;

a compressor impeller accommodated in the compressor chamber;

a diffuser passage, which communicates with the compressor chamber and has a shape surrounding the compressor chamber;

a diffuser surface, which faces the diffuser passage; and a cooling passage, which extends along the diffuser surface, wherein a fluid for cooling the diffuser surface flows through the cooling passage, wherein the compressor housing member includes a plurality of pieces, which are assembled to each other, and the cooling passage is defined by the pieces, which are assembled to each other, wherein the compressor housing member includes the compressor chamber, an intake port, which extends in an axial direction of the compressor impeller and communicates with the compressor chamber, and a compressor scroll passage, which surrounds the compressor impeller, communicates with an outer peripheral portion of the diffuser passage, and has a spiral shape, the pieces include a cylindrical first piece, which defines the compressor scroll passage, a cylindrical second piece, which defines the compressor chamber and the diffuser passage, a third piece, wherein the first piece and the third piece together define the compressor scroll passage, and a cylindrical fourth piece, which defines the intake port, the first piece has a recess, which has an opening along the cooling passage to define the cooling passage, the second piece includes a passage-defining flange, which supports the first piece and closes the recess, and an inner circumferential surface having an internal thread portion, and the fourth piece includes an external thread portion, which is configured to be threaded to the internal thread portion, and a flange, wherein the flange and the passage-defining flange together hold the first piece.

* * * * *